United States Patent [19]

Patzer

[11] 4,030,796

[45] June 21, 1977

[54] ELECTRICAL CONNECTOR

[75] Inventor: Michael D. Patzer, Boulder, Colo.

[73] Assignee: Valleylab, Inc., Boulder, Colo.

[22] Filed: Jan. 16, 1976

[21] Appl. No.: 649,622

[52] U.S. Cl. ..... 339/61 R; 339/184 R

[51] Int. Cl.[2] ..... H01R 13/62

[58] Field of Search ..... 339/59–63, 339/74, 176 P, 195 A, 196 A, 200 P, 255 P, 260, 261, 184, 186

[56] References Cited

UNITED STATES PATENTS

| | | | |
|---|---|---|---|
| 2,755,452 | 7/1956 | Rogie | 339/196 A |
| 3,039,075 | 6/1962 | Stollman | 339/184 R |
| 3,699,495 | 10/1972 | Raynor | 339/128 |
| 3,774,143 | 11/1973 | Lopin | 339/61 R |
| 3,899,239 | 8/1975 | Allard | 339/255 P |
| 3,914,007 | 10/1975 | Seidler | 339/255 P |
| 3,937,546 | 2/1976 | Clewes et al. | 339/61 R |

*Primary Examiner*—Joseph H. McGlynn
*Attorney, Agent, or Firm*—O'Rourke, Harris & Hill

[57] ABSTRACT

A single or multichannel electrical connector including a male connector having at least two prongs depending resiliently from a base, the prongs each having defined in the outer edge thereof a notch with at least one of the notches having at least one conductor exposed at the bottom portion of the notch, the conductor extending internally through the prong, the prongs also having end portions with outwardly facing mutually inclined surfaces, the male connector being adapted to fit a female connector having an opening defined therethrough and configured to receive the prongs with the sides of the notches engaging the front and back endwalls of the female connector adjacent the opening and the connector in the bottom of the notch engaging a contact in a sidewall of the opening in the female connector such that the male connector may be inserted by engaging the opposed inclined planes of the prongs within the opening of the female connector, deforming the prongs towards one another to pass through the female connector thereupon again expanding the prongs to bring the contact of the female connector into engagement with the conductor of the male connector with the notches engaging the front and back end walls of the female connector to secure the male connector therein. In the event more than one conductor is provided in a prong, the prong may be formed of independent sections.

14 Claims, 8 Drawing Figures

ELECTRICAL CONNECTOR

BACKGROUND OF THE INVENTION

1. Field of the Invention

The present invention relates generally to electrical connectors and more particularly to a deformable, conveniently produced, electrically and mechanically secure connector.

2. Description of the Prior Art

Electrical connectors have been produced in almost enumerable shapes and configurations. The more complex connectors may involve recessed electrical conductors and positive locking between the connectors requiring, for instance, either an integral or separate tool to permit the connectors to be released.

The more simple, common connectors often involve exposed electrodes and detents which loosely fix the connectors together but which are displaceable to permit parting of the connectors.

Among the more desirable features not readily obtained in a single connector are recessed or protected electrodes, positive interlocking with convenient joinder and parting of the connector, and simplicity of manufacture with modestly prices materials.

SUMMARY OF THE INVENTION

The present invention, which provides a heretofore unavailable combination of desirable features over previous electrical connectors, comprises a male connector having at least two prongs depending deformably from a base, the prongs having outwardly oriented inclined planes at the ends thereof and notches defined therein with one or more conductors exposed within at least one of the notches. The connector is readily joined by inserting the prongs in the openings of a female connector by elastic deformation of the prongs as the opposed inclined planes move into the female connector with, upon passing through the female connector, the notches engaging the front and back endwalls of the female connector and each conductor of the male connector engaging a contact on a sidewall of the opening within the female connector to thus provide a sure interlock between the connectors and as well as excellent electrical contact between the connectors.

Accordingly, an object of the present invention is to provide a new and improved electrical connector.

Another object of the present invention is to provide a new and improved electrical connector which may be positively interlocked.

Yet another object of the present invention is to provide a new and improved electrical connector which may be conveniently disengaged.

Still another object of the present invention is to provide a new and improved electrical connector which positively engages the electrical contacts of the connector portions.

Yet another object of the present invention is to provide a new and improved electrical connector which may be formed of economical, polymeric material.

Still another object of the present invention is to provide a new and improved electrical connector which may be formed by injection molding.

A further object of the present invention is to provide a new and improved electrical connector in which, in a preferred embodiment, the electrical conductors are recessed and protected from inadvertent contact with the user of the connector.

These and other objects and features of the present invention will become apparent from the following descriptions.

DETAILED DESCRIPTION OF THE INVENTION

Figure 1:
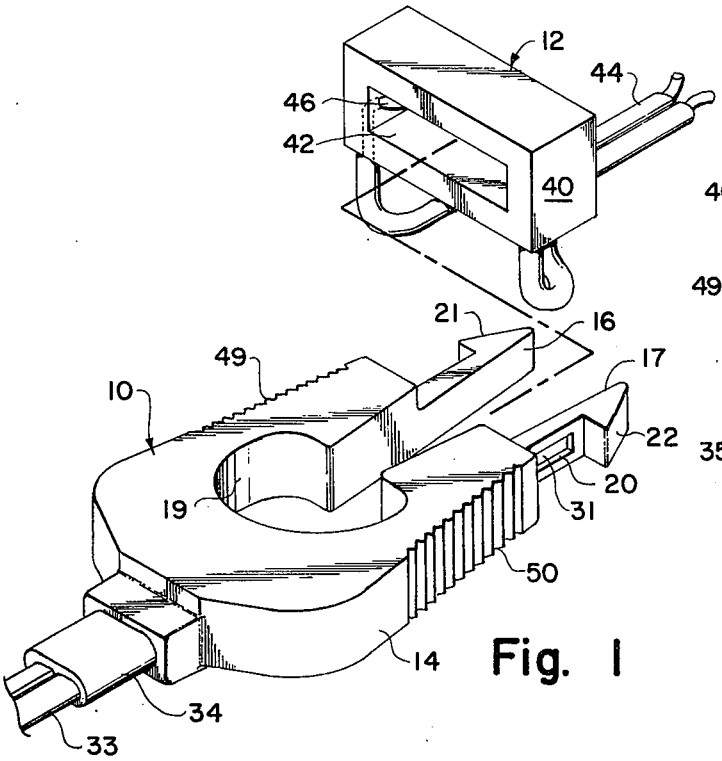
FIG. 1 is a perspective view of a male connector and complementary female connector in acccordance with the present invention.

Turning now to the drawing, wherein similar components are designated by like reference numerals throughout the various figures, a connector according to the instant invention is illustrated in FIG. 1 with the male connector portion generally designated by the reference number 10 and the female connector portion generally designated by the reference numeral 12. As shown in FIG. 1, male connector 10 is a longitudinally symetrical bifurcated connector having a base portion 14, and left and right prongs 16 and 17 respectfully. Prongs 16 and 17 are preferably delineated in part by keyhole shaped opening 19 defined through connector 10. Opening 19 is preferred to lend elastic deformation to connector 10, but prongs 16 and 17 are inherently deformed. Each of prongs 16 and 17 have opposed inclined surfaces 21 and 22 defined on the end portions thereof. As can be seen in more detail in FIGS. 2 and 3, prongs 16 and 17 have defined therein immediately behind inclined surfaces 21 and 22 notches 24 and 25 respectively. At the bottom of notches 24 and 25, recesses 27 and 28 expose internal electrodes 30 and 31. Two channel cord 33 is, in part, formed internally of male connector 10 by entering through sleeve 34, and bifurcates to join electrodes 30 and 31 at joints 35 and 36 respectfully.

Figure 2:
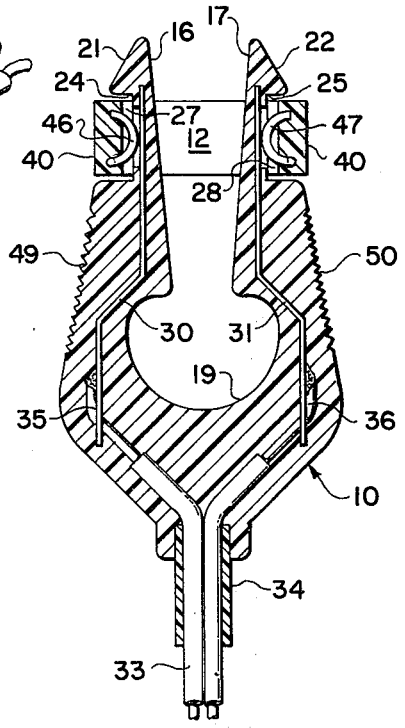
FIG. 2 is a sectioned top view of the male and female connectors of FIG. 1 in an engaged relationship.

Female connector 12, as shown in FIGS. 1 and 2, is formed of, for instance, block 40 having opening 42 defined therein. Two channel cord 44 is connected to left contact 46 and right contact 47 formed in block 40 exposed in the sidewalls of opening 42.

As shown particularly in FIG. 2, male connector 10 engages female connector 12 by passing prongs 16 and 17 into opening 42 and thereafter spreading prongs 16 and 17 to engage opening 42 at the back and front surfaces thereof by notches 24 and 25. As prongs 16 and 17 spread outward, contacts 46 and 47 of female connector 12, which are in the form of protruding wire loops, seat in recesses 27 and 28 defined in notches 24 and 25 to contact electrodes 30 and 31 of male connector 10. Since prongs 16 and 17 are somewhat distended from the relaxed position, electrodes 30 and 31 are urged with positive force into electrical engagement with contacts 46 and 47.

As is apparent from FIG. 2, male connector 10 is securely positioned within female connector 12 as a result of notches 24 and 25 interlocking with block 40 at the front and back sidewalls thereof adjacent opening 42. However, male connector 10 may be conveniently and readily removed from female connector 12 by grasping male connector 10 at grooved areas 49 and 50 compressing yieldable prongs 16 and 17 together to facilitate withdrawal of male connector 10 from female connector 12.

Figure 3:
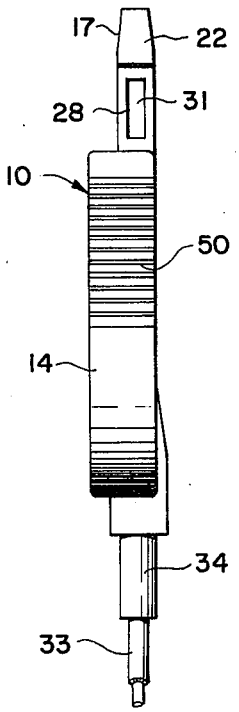
FIG. 3 is a side view of the male connector of FIG. 1.

As shown in FIGS. 2 and 3, electrode 31 is not readily contacted by a user even if male connector 10 is inadvertently grasped within notch 25 since electrode 31 is positioned at the bottom of recess 28 which is configured to preclude admission of a user's hand or fingers.

Figure 4:
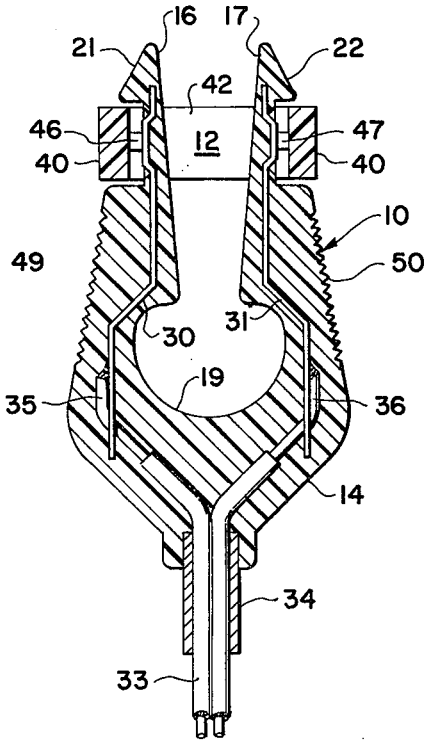
FIG. 4 is a sectioned top view of another embodiment of male and female connectors in accordance with the present invention.
Figure 5:
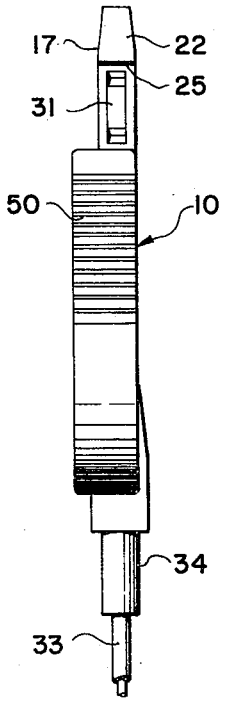
FIG. 5 is a side view of the male connector of FIG. 4.

In instances in which protection of electrodes 30 and 31 from contact with the user are not of importance, the embodiment of the invention shown in FIGS. 4 and 5 may be employed. As will be apparent, FIGS. 4 and 5 illustrate male connector 10 and female connector 12 which are quite similar to that of FIGS. 1 through 3, and accordingly similar parts are similarly numbered. However, it will be noted that electrodes 30 and 31 are positioned to lie exposed directly in the bottoms of notches 24 and 25. Also, contacts 46 and 47 on female connector 12 may be, as illustrated, simple posts extending along the sidewalls of opening 42.

FIG. 5 illustrates the exposure of electrode 31 at the bottom surface of notch 25 in prong 17. The function and manipulation of the embodiment of FIGS. 4 and 5 is the same as that described in detail with regard to FIGS. 1, 2 and 3.

Figure 6:
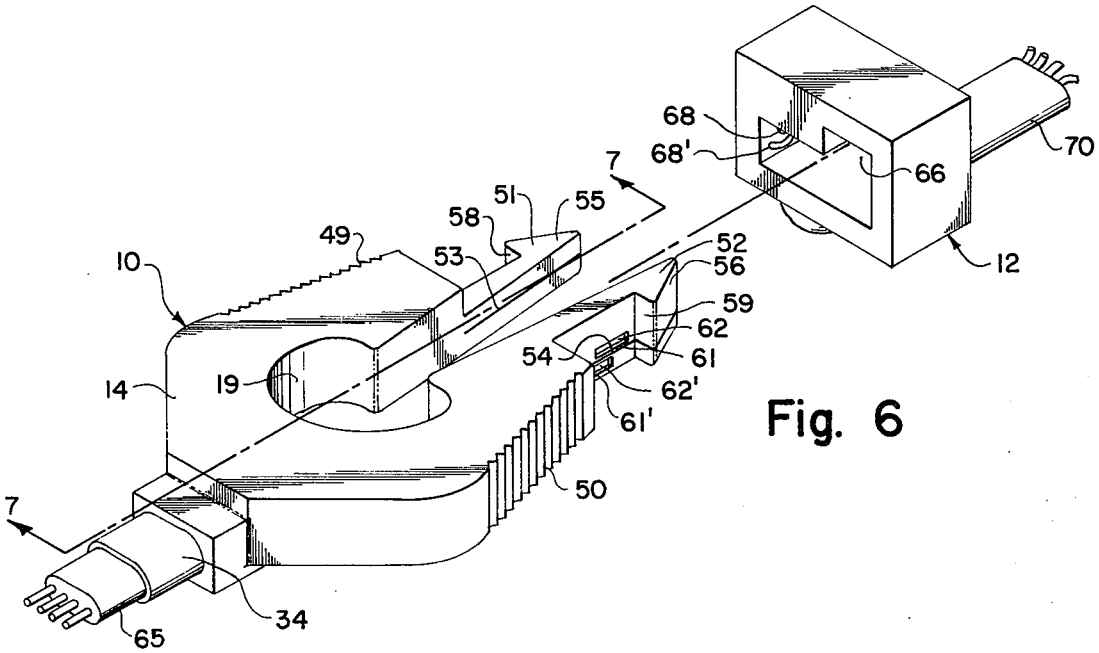
FIG. 6 is a perspective view of multichannel male and female connectors in accordance with the present invention.
Figure 7:
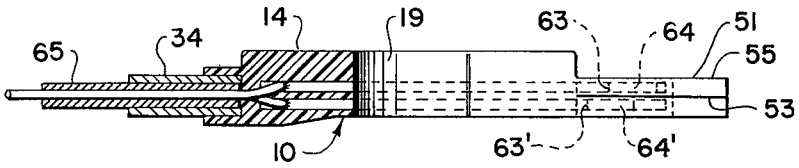
FIG. 7 is a centrally sectioned side view of the male connector of FIG. 6.
Figure 8:
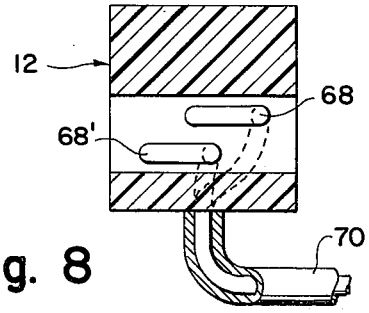
FIG. 8 is a centrally sectioned side view of the female connector of FIG. 6.

Some of the more apparent variations on the concept of the instant invention are illustrated in FIGS. 6 through 8. As shown in FIG. 6, male connector 10 is, in essence, as described above with base 14, keyhole opening 19 and grooved areas 49 and 50. However, prongs 51 and 52 are of different thicknesses and have slits 53 and 54 extending therethrough. Inclined surfaces 55 and 56 and notches 58 and 59 are essentially of the configuration and for the purposes described above. However, as shown in FIGS. 6 and 7, recesses 61, 61', 63 and 63' provide four openings with two on each of prongs 51 and 52 and, on each prong, one above slits 53 and 54 and one below. Conductors 62, 62', 64 and 64' are positioned in the bottom of recesses 61, 61', 63 and 63' respectively. Thus it will be seen that four conductors are provided and situated in a manner rather similar to that previously discussed with regard to FIGS. 1, 2 and 3. As shown particularly well in FIG. 7, conductors 64 and 64' extend through base 14, sleeve 34 to four channel cord 65.

Female connector 12 is also somewhat modified. L-shaped opening 66 is defined in female connector 12 in such a manner as to admit prongs 51 and 52 only in the orientation illustrated in FIG. 6. Obviously, if male connector 10 is rotated 180 degrees around the longitudinal axis, prong 52 will not fit into the narrow portion of L-shaped opening 66. Independent contacts 68 and 68' are provided on each inner sidewall of L-shaped opening 66 to receive, as illustrated in FIG. 6, conductors 64 and 64' respectively. Since prong 51 is sectioned along its length by slit 53, conductors 64 and 64' independently bear against contacts 68 and 68'. Thus, while basically utilizing the configuration of FIGS. 1 through 3, the embodiment of FIGS. 6 through 8 provide for four channel elctrical interconnection, with polarized probes and independent urging of each male connector conductor against the appropriate female connector contact.

Summarily, the connectors of the instant invention may be readily produced by inserting conductors and/or contacts with joined cords into a die cavity, injecting, for instance, high density polypropylene to form the connectors, and simply removing the formed connectors from the die after cooling. The simplicity does not in any way compromise the certainty of connection, i.e., with the notches of the male connector positively interfacing with the front and back walls adjacent the opening of the female connector and the electrical conductors of the male conductor are urged positively into contact with the contacts of the female connector. But even with such positive physical and electrical interconnection, the connectors may be readily removed by merely grasping the male connector, elastically deforming the prongs toward one another, and withdrawing the male connector from the female connector. Thus not only simplicity and economy are provided, but the performance is equal to, and in many cases superior to, much more complicated forms of electrical connectors.

Although but several of the numerous possible embodiments of the present invention have been illustrated and described, it is anticipated that various changes and modifications will be apparent to those skilled in the art, and that such changes may be made without departing from the scope of the invention as defined by the following claims.

What is claimed is:

1. An electrical connector combination comprising: a male connector comprising a base portion, at least two substantially parallel resilient prongs extending from the base portion, a notch having a bottom portion defined in the outer side portion of each prong, at least one electrical conductor positioned within a prong and exposed at the bottom portion of the notch defined in the prong, and outwardly facing inclined surfaces defined between the terminus of each prong and the notch defined therein, the inclined surfaces extending to the terminus of each prong being in a diverging relationship from the termini of the prongs to the notches defined in the prongs; a female connector comprising a member having an opening with opposed sidewalls defined therein and adapted to receive the prongs of the male connector with the greatest distance between the termini of the prongs in the undistorted position being less than the distance between the sidewalls of the female connector, and at least one electrical contact positioned on an internal sidewall of the opening and adapted to bear upon the exposed conductor of the male connector when the male connector is situated in the female connector; whereby, the male connector may be inserted into the female connector by engaging the inclined surfaces of the male connector with the sidewalls of the opening defined in the female connector, inserting the prongs into the opening defined in the female connector, and thus elastically deforming the prongs together and permitting the prongs to expand thereby positioning the male connector by means of the side edges of the notches bearing upon the female connector with the exposed conductor bearing upon the contact.

2. An electrical connector combination as set forth in claim 1 in which each prong of the male connector carries at least one conductor which is exposed in the bottom of the notch defined in each prong and at least one contact is positioned on each internal sidewall of the female conductor.

3. An electrical connector combination as set forth in claim 1 in which a recess is defined at the bottom of each notch in each prong carrying a conductor with the conductor being exposed at the bottom of the recess, and the female connector contact is in the form of at least one loop protruding from a sidewall of the opening defined in the female connector.

4. An electrical connector combination as set forth in claim 1 in which each conductor in the male connector is positioned flush with the bottom of the notch defined in the prong, and the contact of the female connector is in the form of an electrical conductant material extending from the sidewall of the opening of the female conductor in a direction transverse to that in which the male connector enters the female connector.

5. An electrical connector combination as set forth in claim 1 in which one of the prongs is of a differing cross-section than the other of the prongs and the opening defined in the female connector is similarly different in cross-section on one side of the opening than on the other side, whereby the prongs of the male connector may be inserted into the opening defined in the female connector in only one orientation.

6. An electrical connector combination as set forth in claim 1 in which at least one prong of the male connector carries two conductors and the female connector has at least two independent contacts disposed in a given sidewall of the opening defined in the female connector.

7. An electrical connector as set forth in claim 6 in which each prong carrying at least two conductors is longitudinally divided between the conductors, whereby each portion of the divided prong is adapted to independently urge each conductor against the associated electrical contact in the female connector.

8. A male electrical connector comprising: a base portion, at least two substantially parallel resilient prongs extending from the base portion, a notch having a bottom portion defined in the outer side portion of each prong, at least one electrical conductor positioned within a prong and exposed at the bottom portion of the notch defined therein, and outwardly facing inclined surfaces defined between the terminus of each prong and the notch defined therein, the inclined surfaces extending to the terminus of each prong and being in a diverging relationship from the termini of the prongs to the notches defined in the prongs with the greatest distance between the termini of the prongs in the undeformed condition being less than the distance between the bottom portions of the notches.

9. An electrical connector as set forth in claim 8 in which each prong of the connector carries at least one conductor which is exposed in the bottom portion of the notch defined in each prong.

10. An electrical connector as set forth in claim 8 in which a recess is defined at the bottom of each notch in each prong carrying a conductor with the conductor being exposed at the bottom of the recess.

11. An electrical connector as set forth in claim 8 in which each conductor in the male connector is positioned flush with the bottom of the notch defined in the prong.

12. An electrical connector as set forth in claim 8 in which one of the prongs of the connector is of a differing cross-section than the other of the prongs.

13. An electrical connector as set forth in claim 8 in which at least one prong of the connector carries two conductors each exposed at the bottom of the notch defined in such prong.

14. An electrical connector as set forth in claim 13 in which each prong carrying at least two conductors is longitudinally divided between the conductors, whereby each portion of the thus divided prong is adapted to be independently movable.

* * * * *